US009850431B2

(12) United States Patent
Young et al.

(10) Patent No.: US 9,850,431 B2
(45) Date of Patent: Dec. 26, 2017

(54) METHOD AND SYSTEM FOR UTILIZING MATERIALS OF DIFFERING THERMAL PROPERTIES TO INCREASE FURNACE RUN LENGTH

(71) Applicant: Foster Wheeler USA Corporation, Houston, TX (US)

(72) Inventors: Bruce T. Young, Mendham, NJ (US); Ronald T. Myszka, Saylorsburg, PA (US)

(73) Assignee: AMEC FOSTER WHEELER USA CORPORATION, Houston, TX (US)

( * ) Notice: Subject to any disclaimer, the term of this patent is extended or adjusted under 35 U.S.C. 154(b) by 753 days.

(21) Appl. No.: 14/199,030

(22) Filed: Mar. 6, 2014

(65) Prior Publication Data

US 2014/0251785 A1 Sep. 11, 2014

Related U.S. Application Data

(60) Provisional application No. 61/774,421, filed on Mar. 7, 2013.

(51) Int. Cl.
*C10G 9/20* (2006.01)
*C10B 29/00* (2006.01)
(Continued)

(52) U.S. Cl.
CPC ..... *C10B 29/00* (2013.01); *C10G 9/005* (2013.01); *C10G 9/203* (2013.01); *F28F 21/081* (2013.01);
(Continued)

(58) Field of Classification Search
CPC ..... F28D 1/0477; F28F 21/081; F28F 27/02; C10G 9/20
(Continued)

(56) References Cited

U.S. PATENT DOCUMENTS 2,028,795 A * 1/1936 McKee ..... C10G 47/32 208/72
2,791,997 A * 5/1957 Monkowski ..... C21D 9/00 126/91 A
(Continued)

FOREIGN PATENT DOCUMENTS

DE 4310538 A1 10/1994
EP 1610081 A1 12/2005
(Continued)

OTHER PUBLICATIONS

Thomas, Shane, "International Search Report" prepared for PCT/US14/21070 dated Jun. 11, 2014, 2 pages.

*Primary Examiner* — Gregory A Wilson
(74) *Attorney, Agent, or Firm* — Winstead PC

(57) ABSTRACT

In one aspect, the present invention relates to a furnace having a heated portion arranged adjacent to an unheated portion. A plurality of straight tubes are formed of a first material and are at least partially disposed in the heated portion. A plurality of return bends are operatively coupled to the plurality of straight tubes. The plurality of return bends are formed of a second material and are at least partially disposed in the unheated portion. The first material exhibits a maximum temperature greater than the second material thereby facilitating increased run time of the furnace. The second material exhibits wear-resistance properties greater than the first material thereby facilitating wear-resistance of the furnace.

7 Claims, 4 Drawing Sheets

(51) Int. Cl.
*C10G 9/00* (2006.01)
*F28F 21/08* (2006.01)
*C10B 55/00* (2006.01)

(52) U.S. Cl.
CPC ..... *C10B 55/00* (2013.01); *C10G 2400/02* (2013.01); *C10G 2400/04* (2013.01); *C10G 2400/08* (2013.01); *Y10T 29/49391* (2015.01)

(58) Field of Classification Search
USPC ..... 126/91 A; 432/175
See application file for complete search history.

(56) References Cited

U.S. PATENT DOCUMENTS 4,093,816 A * 6/1978 Case ..... H05B 3/64 126/91 A
4,297,147 A 10/1981 Nunciato et al.
4,444,589 A 4/1984 Sugitani et al.
4,444,731 A * 4/1984 Konoki ..... B01J 19/0026 138/141
5,985,186 A * 11/1999 Kasprzyk ..... C04B 35/806 264/29.7
6,187,147 B1 * 2/2001 Doerksen ..... F28F 19/02 202/99
6,237,545 B1 * 5/2001 Barnett ..... C10G 9/20 122/235.23
7,670,462 B2 3/2010 Gibson et al.
7,895,957 B2 * 3/2011 Inomata ..... F22B 31/0023 110/245
8,733,619 B2 * 5/2014 Lalam ..... B23K 9/0282 219/101
2004/0109784 A1 6/2004 Arbab et al.
2007/0158240 A1 7/2007 Gregory
2009/0107888 A1 * 4/2009 Sanchez ..... F23M 20/00 208/132
2010/0307429 A1 12/2010 Komai et al.
2011/0316271 A1 12/2011 Lalam
2014/0041844 A1 2/2014 Lindell et al.

FOREIGN PATENT DOCUMENTS

GB 340876 A 1/1931
GB 733647 A 7/1955
GB 744313 A 2/1956
GB 2100284 A 12/1982
GB 2100405 A 12/1982
WO WO-2005040439 A1 5/2005

* cited by examiner

METHOD AND SYSTEM FOR UTILIZING MATERIALS OF DIFFERING THERMAL PROPERTIES TO INCREASE FURNACE RUN LENGTH

CROSS-REFERENCE TO RELATED APPLICATIONS

This application claims priority to, and incorporates by reference for any purpose the entire disclosure of, U.S. Provisional Patent Application No. 61/774,421, filed Mar. 7, 2013.

BACKGROUND

Field of the Invention

The present invention relates generally to an apparatus for refining operations, and more particularly, but not by way of limitation, to delayed coking operations utilizing a heater coil having straight tubes constructed of a first material and return bends constructed of a second material wherein the first material and the second material exhibit differing thermal properties, in particular, but not by way of limitation, design-maximum tube-metal temperatures.

History of the Related Art

Delayed coking refers to a refining process that includes heating a residual oil feed, made up of heavy, long-chain hydrocarbon molecules, to a cracking temperature in a furnace. Typically, furnaces used in the delayed coking process include a plurality of tubes arranged in a multiple-pass configuration. Heating of the residual oil feed cracks the heavy, long-chain hydrocarbon molecules producing gas, lightweight products, and solid coke. The gas and lightweight products are further refined into various liquid fuels and gas fuels. The solid coke is subsequently crushed and sold as a fuel source.

During the delayed coking process, solid coke forms on an inside surface of the plurality of tubes. This phenomenon is known as "fouling." Solid coke is an insulator and causes a temperature of a material forming the plurality of tubes (referred to herein as a "tube-metal temperature") to incrementally increase during operation. For example, a clean tube may require a tube-metal temperature of, for example, 945° F. to heat the residual oil feed to 900° F. In contrast, a fouled tube might require a substantially higher tube-metal temperature to heat the residual oil feed to 900° F. Over a period of use, the plurality of tubes eventually reach a design-maximum tube-metal temperature. As used herein, the term "design-maximum tube metal temperature" refers to a maximum safe operating temperature of the plurality of tubes. Above the design-maximum tube metal temperature, thermal stresses can contribute to wear and fatigue of the plurality of tubes thereby rendering the furnace unsafe for operation. Upon reaching the design-maximum tube-metal temperature, the plurality of tubes must be cleaned to remove the solid coke. Cleaning brings the plurality of tubes back to the tube-metal temperature conditions associated with a clean tube.

Cleaning the plurality of tubes typically involves at least one of mechanical cleaning, steam-air decoking, pigging, or online spalling. Online spalling involves removing a fouled pass including a plurality of tubes from service and thermally shocking the plurality of tubes. The plurality of tubes are rapidly heated (expanded) and cooled (contracted) over a set period of time. During cooling, the fouled tube contracts causing a portion of the solid coke accumulated therein to break free. The solid coke is flushed out of the fouled tube and processed in a coke drum. The advantage of online spalling is that only one pass is spalled at a time allowing remaining passes to operate normally. However, the efficacy of online spalling may decrease each time it is performed.

Pigging involves passing a foam or plastic "pig" having metal studs and grit through the tube. As the pig passes through the fouled tube, the pig rotates and scrapes the solid coke from an inside surface of the fouled tube. Steam-air decoking involves circulating a steam-air mixture through the plurality of tubes at elevated temperatures. Air from the steam-air mixture is used to burn the solid coke from the inside surface of the plurality of tubes while steam from the steam-air mixture ensures that the burning temperatures do not exceed the design-maximum tube-metal temperature.

In most cases, during cleaning, at least a pass of the plurality of tubes must be removed from the residual oil feed. In some cases, the entire furnace must be taken out of service. This results in a reduction of productivity and a loss of profits. Thus, it is of great importance to design the furnace to maximize a period of time between cleanings.

U.S. Pat. No. 7,670,462, assigned to Great Southern Independent L.L.C., relates to a system and method for on-line cleaning of black oil heater tubes and delayed coker heater tubes. A high-pressure water charge is injected through the heater tubes during normal process operations to prevent heater tube fouling and downtime. The water charge undergoes intense boiling and evaporation. The intense boiling induces a scrubbing action within the heater tubes. Furthermore, a shocking action is induced by expansion and contraction of the heater tubes resulting from the water charge flowing through the heater tubes followed by a hotter process fluid flowing through the heater tubes.

U.S. Patent Application Publication No. 2007/0158240, assigned to D-COK, LP relates to a system and method for on-line spalling of a coker. An off-line heater pipe is added to on-line coker heater pipes. When an on-line pipe is to be spalled, flow is diverted to the off-line pipe thus allowing for full operation of the coker heater.

SUMMARY

The present invention relates generally to refining operations. In one aspect, the present invention relates to a furnace having a heated portion arranged adjacent to an unheated portion. A plurality of straight tubes are formed of a first material and are at least partially disposed in the heated portion. A plurality of return bends are operatively coupled to the plurality of straight tubes. The plurality of return bends are formed of a second material and are at least partially disposed in the unheated portion. The first material exhibits a design-maximum tube-metal temperature greater than the second material thereby facilitating increased run time of the furnace. The second material exhibits wear-resistance properties greater than the first material thereby facilitating wear-resistance of the furnace.

In another aspect, the present invention relates to a method of manufacturing a heater process coil. The method includes forming a plurality of straight tubes from a first material and forming a plurality of return bends from a second material. The plurality of straight tubes are joined to the plurality of return bends. The plurality of straight tubes and the plurality of return bends are oriented within a furnace such that the plurality of straight tubes are at least partially disposed within a heated portion and the plurality of plug headers are at least partially disposed within an unheated portion. The first material exhibits a design-maximum tube-metal temperature greater than the second material thereby facilitating increased run time of the furnace. The second material exhibits wear-resistance properties greater than the first material thereby facilitating wear-resistance of the furnace.

BRIEF DESCRIPTION OF THE DRAWINGS

A more complete understanding of the method and system of the present invention may be obtained by reference to the following Detailed Description when taken in conjunction with the accompanying drawings wherein.

DETAILED DESCRIPTION

Various embodiments of the present invention will now be described more fully with reference to the accompanying drawings. The invention may, however, be embodied in many different forms and should not be construed as limited to the embodiments set forth herein; rather, the embodiments are provided so that this disclosure will be thorough and complete, and will fully convey the scope of the invention to those skilled in the art.

Figure 1:
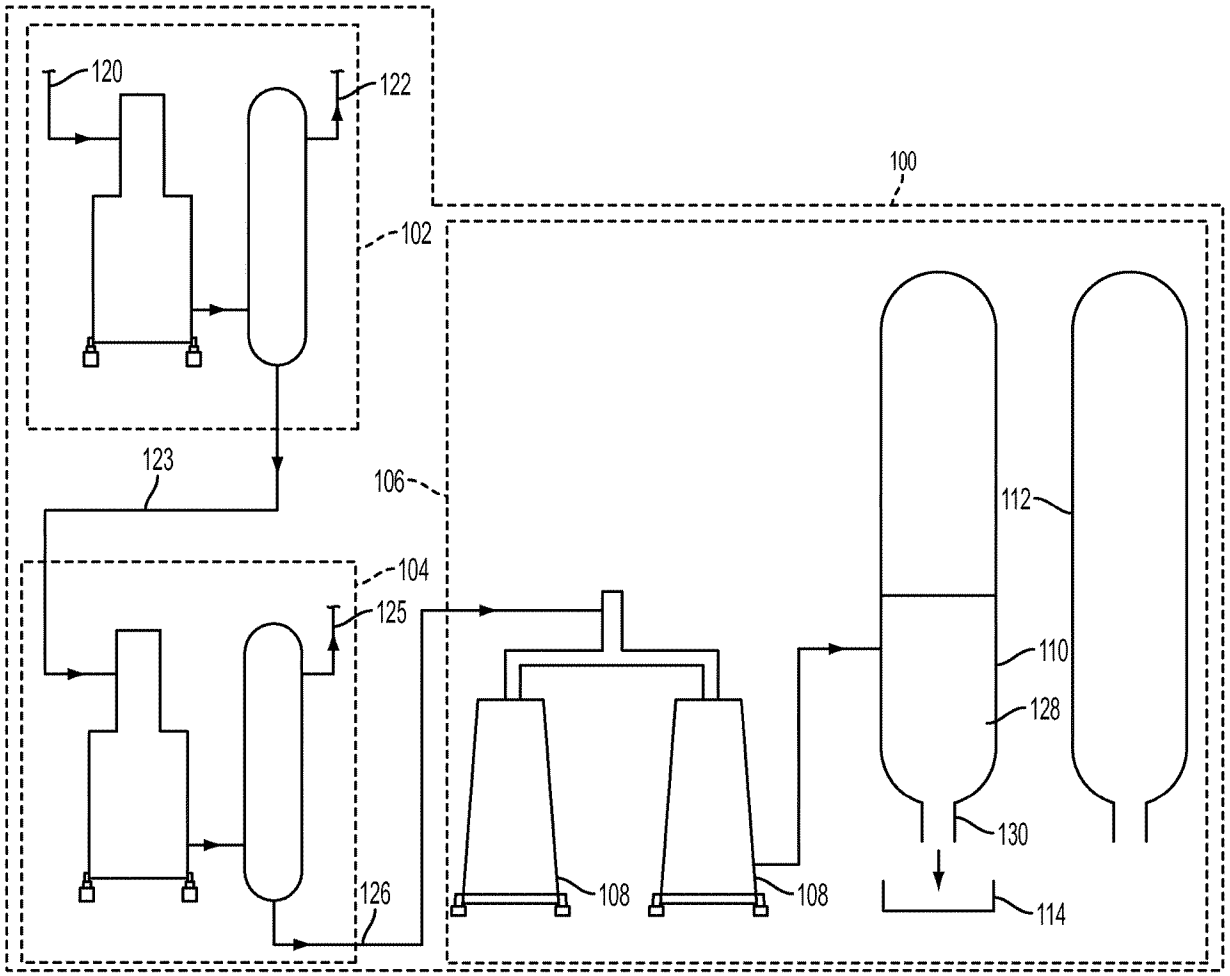
FIG. 1 is a schematic diagram of a refining system according to an exemplary embodiment.

FIG. 1 is a schematic diagram of a refining system according to an exemplary embodiment. A refining system 100 includes an atmospheric-distillation unit 102, a vacuum-distillation unit 104, and a delayed-coking unit 106. In a typical embodiment, the atmospheric-distillation unit 102 receives a crude oil feedstock 120. Water and other contaminants are typically removed from the crude oil feedstock 120 before the crude oil feedstock 120 enters the atmospheric distillation unit 102. The crude oil feedstock 120 is heated under atmospheric pressure to a temperature range of, for example, between approximately 650° F. and approximately 700° F. Lightweight materials 122 that boil below approximately 650° F.-700° F. are captured and processed elsewhere to produce, for example, fuel gas, naphtha, gasoline, jet fuel, and diesel fuel. Heavier materials 123 that boil above approximately 650° F.-700° F. (sometimes referred to as "atmospheric residuum") are removed from a bottom of the atmospheric-distillation unit 102 and are conveyed to the vacuum-distillation unit 104.

Still referring to FIG. 1, the heavier materials 123 enter the vacuum-distillation unit 104 and are heated at very low pressure to a temperature range of, for example, between approximately 700° F. and approximately 800° F. Light components 125 that boil below approximately 700° F.-800° F. are captured and processed elsewhere to produce, for example, gasoline and asphalt. A residual oil feed 126 that boils above approximately 700° F.-800° F. (sometimes referred to as "vacuum residuum") is removed from a bottom of the vacuum-distillation unit 104 and is conveyed to the delayed-coking unit 106.

Still referring to FIG. 1, according to exemplary embodiments, the delayed-coking unit 106 includes a furnace 108 and a coke drum 110. The residual oil feed 126 is preheated and fed to the furnace 108 where the residual oil feed 126 is heated to a temperature range of, for example, between approximately 900° F. and approximately 940° F. After heating, the residual oil feed 126 is fed into the coke drum 110. The residual oil feed 126 is maintained at a pressure range of, for example, between approximately 25 psi and approximately 75 psi for a predetermined cycle time until the residual oil feed 126 separates into hydrocarbon vapors and solid coke 128. In a typical embodiment, the predetermined cycle time is approximately 10 hours to approximately 24 hours. Separation of the residual oil feed 126 is known as "cracking." The solid coke 128 accumulates starting at a bottom 130 of the coke drum 110.

Still referring to FIG. 1, according to exemplary embodiments, after the solid coke 128 reaches a predetermined level in the coke drum 110, the solid coke 128 must be removed from the coke drum 110 through, for example, mechanical or hydraulic methods. Removal of the solid coke 128 from the coke drum 110 is known as, for example, "cutting," "coke cutting," or "decoking." Flow of the residual oil feed 126 is diverted from the coke drum 110 to at least one second coke drum 112. The coke drum 110 is then steamed to strip out remaining uncracked hydrocarbons. After the coke drum 110 is cooled by, for example, water injection, the solid coke 128 is removed via, for example, mechanical or hydraulic methods. The solid coke 128 falls through the bottom 130 of the coke drum 110 and is recovered in a coke pit 114. The solid coke 128 is then shipped from the refinery to supply the coke market. In various embodiments, flow of the residual oil feed 126 may be diverted to the at least one second coke drum 112 during decoking of the coke drum 110 thereby maintaining continuous operation of the refining system 100.

While cracking of the residual oil feed 126 primarily takes place within the coke drum 110, premature cracking often occurs within portions of the furnace 108. Premature cracking leads to fouling of the furnace 108 thereby necessitating periodic cleaning of the furnace 108. Increased feed rates commonly associated with many refining operations present the potential for rapid fouling of the furnace 108. In many cases, any increase in productivity of the furnace 108 results in increased production throughout the refining system 100.

To this end, efforts have been made to construct the furnace 108 from materials having higher design-maximum tube-metal temperatures. For example, austenitic materials such as, for example, TP347H have a design-maximum tube-metal temperature approximately 200° F. higher than commonly-used ferritic materials such as, for example, 9Cr-1Mo; however, austenitic materials are considerably softer than ferritic materials and often experience excessive wear and erosion. Such wear and erosion can lead to premature failure of the furnace 108 resulting in loss of production and costly repairs. Thus a design of the furnace 108 is needed that utilizes materials of sufficient strength to prevent premature wear of the furnace 108 but allows for a longer operation time between successive cleanings.

Figure 2A:
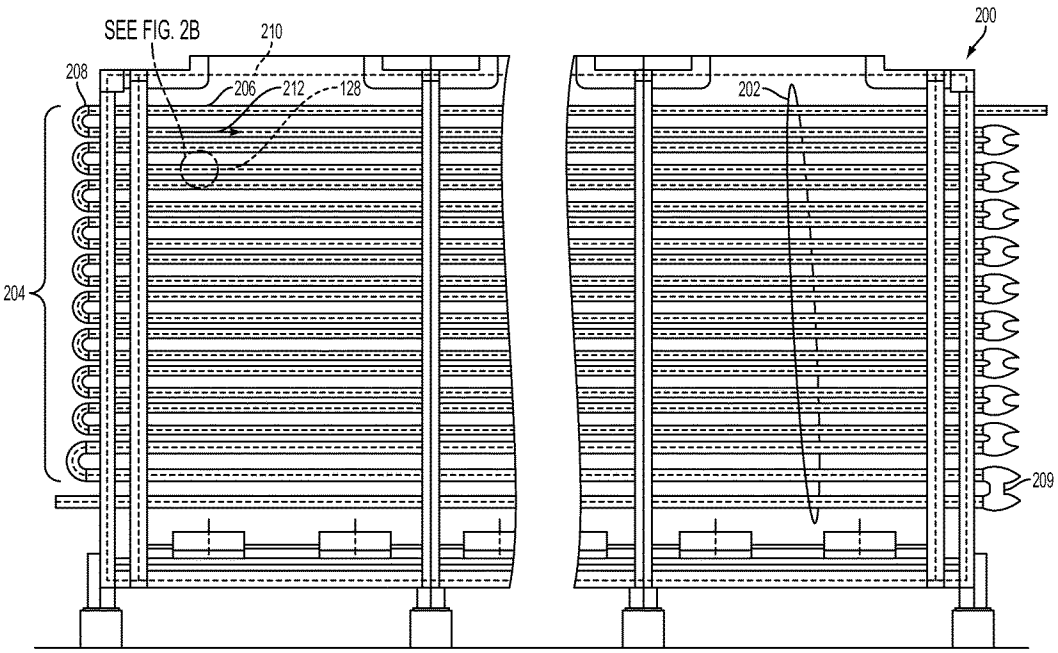
FIG. 2A is a plan view of a furnace according to an exemplary embodiment.
Figure 2B:
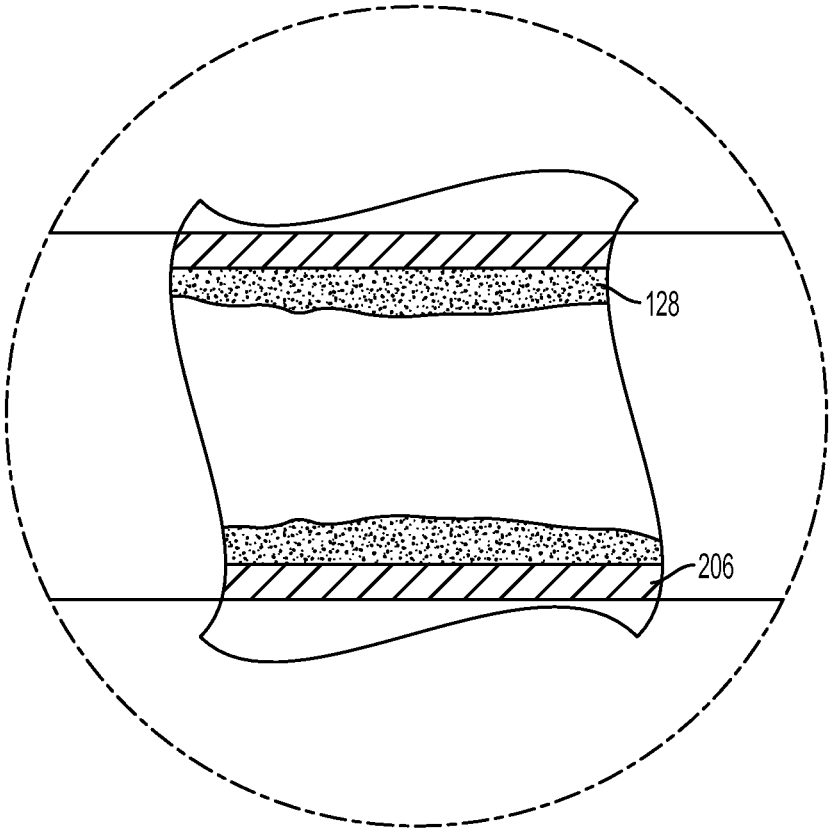
FIG. 2B is a cross-sectional view of a furnace tube showing an accumulation of solid coke therein.

FIG. 2A is a plan view of a furnace according to an exemplary embodiment. FIG. 2B is a cross-sectional view of a furnace tube showing an accumulation of solid coke therein. Referring to FIGS. 2A and 2B, a furnace 200 includes a heater process coil 202 arranged in a plurality of flow passes 204. In various embodiments, the furnace 200 may be, for example, a delayed coker heater, a crude heater, a vacuum heater, a visc breaker heater, or any other appropriate device for heating fluid in a refining operation. The plurality of flow passes 204 includes a plurality of straight tubes 206 connected to a plurality of return bends 208 and a plurality of plug headers 209. In a typical embodiment, the plurality of return bends 208 are wrought or cast 180° bends with a heavy back wall that connect, at one end, two straight tubes of the plurality of straight tubes 206. In some embodiments, furnaces utilizing principles of the invention may include return bends at both ends of the straight tubes 206. The plurality of plug headers 209 are cast and are disposed at an opposite end of the plurality of straight tubes 206 and connect two straight tubes of the plurality of straight tubes 206. The plurality of return bends 208 and the plurality of plug headers 209 are disposed outside of a heated portion 210 of the furnace 200. Thus, in a typical embodiment, the tube-metal temperature of the plurality of return bends 208 and the plurality of plug headers 209 will not exceed a temperature of a fluid 212 contained therein. The plurality of straight tubes 206 are located within the heated portion 210 of the furnace 200. Thus, a tube-metal temperature of the plurality of straight tubes 206 will be higher than the temperature of the fluid 212 contained therein due to an insulating effect of the solid coke 128 accumulated therein. In a typical embodiment, a maximum tube-metal temperature of a clean straight tube 206 is approximately 1030° F.

Still referring to FIGS. 2A and 2B, during operation of the furnace 200, the tube-metal temperature of the plurality of straight tubes 206 rises at a rate of approximately 1.5° F. per day due to accumulation of solid coke therein. For straight tubes 206 constructed of ferritic material such as, for example, 9Cr-1Mo, an online spalling process begins when the tube-metal temperature of the plurality of straight tubes 206 reaches, for example, approximately 1250° F. or more. As previously discussed, online spalling requires removing at least one flow pass of the plurality of flow passes 204 from operation. Use of austenitic materials such as, for example, TP347H in the plurality of straight tubes 206 allows for an additional 200° F. of temperature rise. This additional temperature rise equates to approximately an additional 130 days of operation between cleanings thereby increasing productivity and profit. However, due to the relative softness of austenitic material, the plurality of return bends 208 and the plurality of plug headers 209 are particularly vulnerable to excessive wear and erosion during spalling. This results in premature failure of the plurality of return bends 208 and the plurality of plug headers 209.

Still referring to FIGS. 2A and 2B, in a typical embodiment, the heater process coil 202 includes the plurality of straight tubes 206 constructed of an austenitic material such as, for example, TP347H and the plurality of return bends 208 and the plurality of plug headers 209 constructed of a ferritic material such as, for example, 9Cr-1Mo. The plurality of return bends 208 and the plurality of plug headers 209 are connected to the plurality of straight tubes 206 through a connection process such as, for example, welding. As previously mentioned, the plurality of straight tubes 206, constructed of the austenitic material, are located within the heated portion 210 of the furnace 200 and the plurality of return bends 208 and the plurality of plug headers 209, constructed of the ferritic material, are located outside of the heated portion 210 of the furnace 200. By placing the plurality of return bends 208 and the plurality of plug headers 209 outside of the heated portion 210, it becomes less likely that the plurality of return bends 208 and the plurality of plug headers 209 will reach the design-maximum tube-metal temperature associated with the ferritic material. Because the ferritic material is harder than the austenitic material, such a configuration allows the benefit of longer run times without problems associated with premature failure of the plurality of return bends 208 and the plurality of plug headers 209.

The advantages of such an arrangement will be apparent to one skilled in the art. For example, by constructing the plurality of straight tubes 206 of the austenitic material, the furnace 200 can operate for approximately an additional 130 days between cleanings thereby increasing productivity and profit. In addition, constructing the plurality of return bends 208 and the plurality of plug headers 209 from the ferritic material reduces wear and erosion of the plurality of return bends 208 and the plurality of plug headers 209. However, by placing the plurality of return bends 208 and the plurality of plug headers 209 outside of the heated portion 210, an operation of the furnace 200 is not limited by the lower design-maximum tube-metal temperature associated with the ferritic material.

Figure 3:
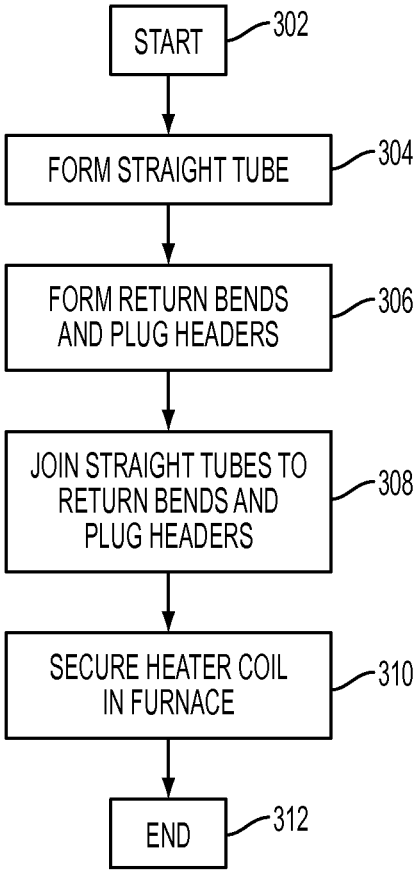
FIG. 3 is a flow diagram of a process for manufacturing a heater coil according to an exemplary embodiment.

FIG. 3 is a flow diagram of a process for manufacturing a heater process coil according to an exemplary embodiment. A process 300 begins at step 302. At step 304, a plurality of straight tubes are formed of an austenitic material. At step 306, a plurality of return bends and a plurality of plug headers are formed of a ferritic material. At step 308, the plurality of straight tubes, the plurality of return bends, and the plurality of plug headers are joined together end-to-end through a connection process such as, for example, welding. According to an exemplary embodiment, care must be taken to utilize a welding material that is compatible with both the ferritic material, the austenitic material, and any fluid that may be disposed therein. That is, the welding material must not induce corrosion of either the ferritic material or the austenitic material. Furthermore, the welding material must accommodate a thermal expansion differential between the ferritic material and the austenitic material.

Still referring to FIG. 3, at step 310, the process heater coil is secured in a furnace such that the plurality of straight tubes are secured within a heated portion of the furnace and the plurality of return bends and the plurality of plug headers are disposed outside of the heated portion. The process 300 ends at step 312. Such an arrangement allows greater operation time of the heater coil between successive cleanings while, at the same time, guards the plurality of return bends against premature wear or failure.

Although various embodiments of the method and system of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth herein.

What is claimed is:

1. A furnace comprising:

a heated portion;

a plurality of straight tubes formed of a first material and at least partially disposed in the heated portion;

a plurality of return bends coupled to the plurality of straight tubes, the plurality of return bends formed of a second material and at least partially disposed outside of the heated portion, wherein properties of the second material facilitate wear resistance of the plurality of return bends;

a plurality of plug headers coupled to the plurality of straight tubes at an end opposite the plurality of return bends, the plurality of plug headers formed of the second material;

wherein the first material exhibits a design-maximum tube-metal temperature greater than the second material thereby facilitating increased run time of the furnace; and wherein the second material exhibits wear-resistance properties greater than the first material facilitating wear resistance of the furnace.

2. The furnace of claim 1, wherein the plurality of plug headers are at least partially disposed outside of the heated portion.

3. The furnace of claim 1, wherein the first material is an austenitic material.

4. The furnace of claim 1, wherein the second material is a ferritic material.

5. The furnace of claim 1, wherein the first material is TP347H.

6. The furnace of claim 1, wherein the second material is 9Cr-1Mo.

7. The furnace of claim 1, wherein the plurality of return bends are 180 degree bends.

* * * * *